US006338206B1

(12) United States Patent
Kita

(10) Patent No.: US 6,338,206 B1
(45) Date of Patent: Jan. 15, 2002

(54) ATHLETIC SHOE SOLE DESIGN AND CONSTRUCTION

(75) Inventor: Kenjiro Kita, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/592,819

(22) Filed: Jun. 13, 2000

(30) Foreign Application Priority Data

Feb. 25, 2000 (JP) ..... 12-049105

(51) Int. Cl.[7] ..... A43B 7/06; A43B 13/20
(52) U.S. Cl. ..... 36/29; 36/3 R; 36/3 B
(58) Field of Search ..... 36/3 R, 3 B, 102, 36/29

(56) References Cited

U.S. PATENT DOCUMENTS 2,098,412 A * 11/1937 Bovay ..... 36/3 R
4,674,200 A * 6/1987 Sing ..... 36/29
4,813,160 A * 3/1989 Kuznetz ..... 36/3 R
4,888,887 A * 12/1989 Solow ..... 36/3 R
5,400,526 A * 3/1995 Sessa ..... 36/3 B
6,092,305 A * 7/2000 Troy et al. ..... 36/3 B

FOREIGN PATENT DOCUMENTS

JP 63-43923 11/1988
JP 8-131204 5/1996

* cited by examiner

*Primary Examiner*—M D. Patterson
(74) *Attorney, Agent, or Firm*—W. F. Fasse; W. G. Fasse

(57) ABSTRACT

A midsole assembly for an athletic shoe comprises a midsole formed of soft elastic material and extending from the heel portion to the forefoot portion of the shoe, a curved groove formed on the bottom side of the forefoot region of the midsole and extending in the substantially lateral direction, a through hole formed in the curved groove and having an opening end on the plantar contact face of the midsole, and a cover portion covering the curved groove. An air tube, which is formed of and surrounded by the curved groove and the cover portion, has opening portions on both ends thereof. The cover portion is integrally formed with the outsole.

19 Claims, 8 Drawing Sheets

ATHLETIC SHOE SOLE DESIGN AND CONSTRUCTION

BACKGROUND OF THE INVENTION

The present invention relates to an athletic shoe sole design and construction, and more particularly, to a sole assembly having a vent or a vent hole formed in a midsole.

The sole of an athletic shoe is generally comprised of a midsole and an outsole. The midsole is typically formed of soft elastic material in order to ensure adequate cushioning properties. The outsole is fitted under the midsole and directly contacts with the ground.

Preferably, ventilation of a shoe is secured in a degree when wearing a shoe. Various kinds of shoes with vent holes have conventionally been proposed.

For instance, the Japanese patent application laying open publication No. 8-131204 discloses a plurality of transverse holes formed at a body portion of the bottom member of a shoe and a plurality of vertical holes also formed at a body portion of the bottom member. The vertical holes communicate with the transverse holes and penetrate through the insole. The Japanese utility model application examined publication No. 63-43923 shows a plurality of through holes penetrating through the upper member of a sole in the thickness direction and a plurality of grooves formed at the lower member of the shoe. Each of the grooves corresponds to each of the through holes.

In both cases, the air flows into a shoe through the transverse holes and the vertical holes, or the through holes and the grooves. Thus, ventilation of the inside of a shoe is acquired.

On the other hand, in an athletic shoe, especially in the case of a running shoe, higher flexibility of the forefoot portion is required. In the prior art construction, however, transverse holes or grooves are merely formed on the body portion or the lower member made of rubber or the like. Thus, these transverse holes and grooves, which are made only in the light of ventilation, cannot satisfy higher flexibility that are required in an athletic shoe.

The object of the present invention is to provide a sole assembly for an athletic shoe that can realize higher flexibility as well as ventilation of the forefoot portion of a shoe.

SUMMARY OF THE INVENTION

The present invention provides a sole assembly for an athletic shoe.

In one embodiment, a sole assembly comprises a midsole extending from the heel portion to the forefoot portion, a curved or bent groove formed on the bottom side of the forefoot portion of the midsole and extending in the general shoe width direction, a through hole that is open on the plantar contact face of the midsole and formed in the curved groove, and a cover portion that covers the curved groove. The curved groove and the cover portion form an air tube.

The air tube may be open at one end or at both ends. An openable and closable valve means may be provided at the opening portion of the air tube. The valve means may be formed of a projection or a protrusion at the bottom portion of the curved groove in the vicinity of the opening portion.

Alternatively, the air tube may be closed at its both ends and an open air intake port communicating with the through hole in the curved groove may be formed at either the midfoot portion or the heel portion of the midsole. Also, the cover portion may be formed integrally with an outsole disposed on the bottom side of the forefoot portion of the midsole.

In use of a shoe, the air is introduced or flows into the inside of the shoe through the curved groove and the through hole, and thus, ventilation can be acquired inside the forefoot portion of the shoe. Moreover, in this case, the thickness of the midsole is smaller at the curved groove formed portion, which causes the midsole to be easier to bend in the vertical direction along the curved groove, thereby improving flexibility or bendability of the forefoot portion. This improved flexibility can realize smoother transfer of the load and secure gripping properties when an athlete or a shoe wearer gets down onto the ground from the heel portion to the toe portion of the shoe.

Furthermore, the opening portion of the through hole on the bottom side is prevented from being exposed to the ground by the cover portion. Thereby, water, sand, dust, and the like outside the shoe are blocked from entering the inside of the shoe via the through hole when the shoe contacts with the ground. In such a way, the shoe can be used as an outdoor shoe as well.

When at least one end of the air tube is open, the open air is introduced into the curved groove through the opening end of the air tube and flows into the inside of the shoe via the through hole from the curved groove.

When the openable and closable valve means is provided, the valve means closes the opening portion of the air tube at the time of bending of the forefoot portion, thereby increasing the air pressure inside the air tube. The pressure increased air in the air tube easily flows into the inside of the shoe via the through hole, which improves ventilation of the shoe.

When a projection or protrusion is provided in the curved groove, it contacts with the cover portion at the time of bending of the forefoot portion, thereby closing the opening portion of the air tube. In this case, because the valve means is formed of a mere projection or protrusion, the structure of the valve means can be simplified.

When both ends of the air tube are closed, the air pressure inside the air tube easily increases at the time of bending of the forefoot portion and the pressure increased air is pushed out of the through hole and flows into the inside of the shoe. In this case, the open air is introduced into the air tube through the intake port formed at the midfoot portion and/or the heel portion of the midsole. Thus, the supply of air to the air tube can be conducted with ease. Additionally, integral formation of the cover portion with the outsole can simplify the whole structure of the sole.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1:
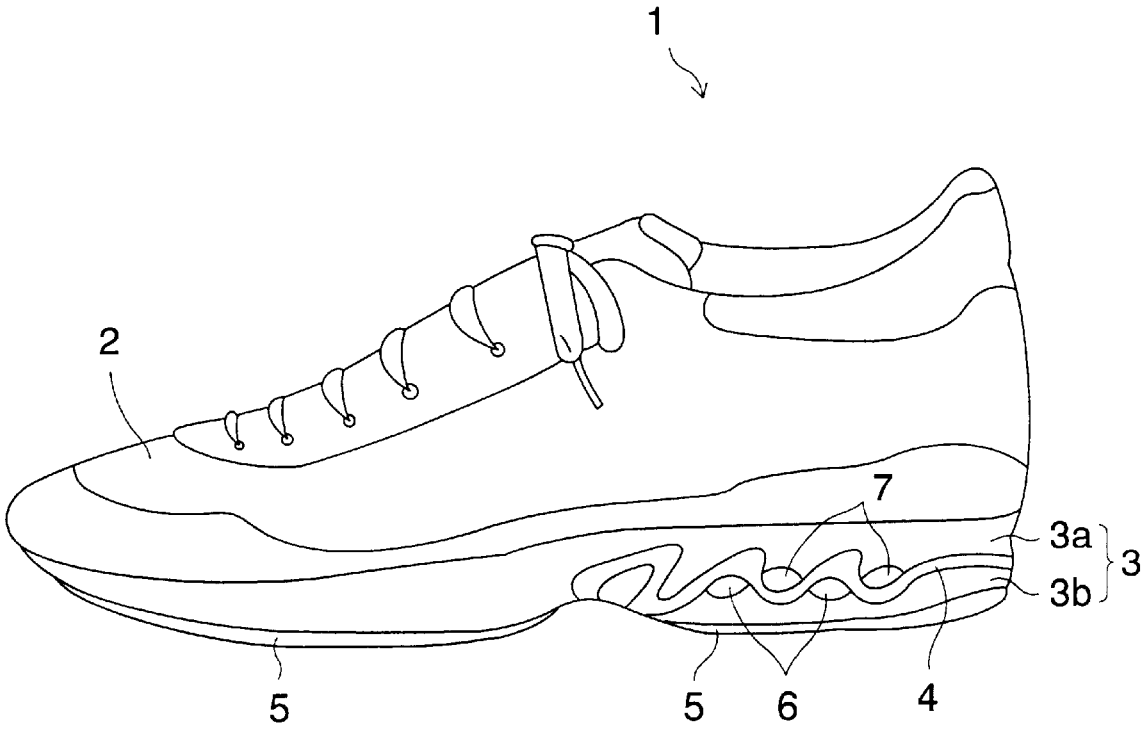
FIG. 1 is a lateral side view of an athletic shoe (left foot side) incorporating the sole construction of the present invention.

Turning now to the drawings, FIG. 1 illustrates an athletic shoe incorporating the sole construction of the present invention. The sole of this athletic shoe 1 comprises a midsole 3, a corrugated sheet 4 and an outsole 5 directly contacting with the ground. The midsole 3 is fitted to the bottom of an upper 2. The corrugated sheet 4 having a wavy configuration is interposed in the midsole 3. The outsole 5 is fitted to the bottom of the midsole 3.

The midsole 3 is provided in order to absorb impact load imparted on the bottom of the shoe 1 when an athlete gets down onto the ground. The midsole 3 is comprised of an upper midsole 3*a* and a lower midsole 3*b* that are respectively disposed on the top and bottom surfaces of the corrugated sheet 4. That is, the corrugated sheet 4 is interposed between the upper midsole 3*a* and the lower midsole 3*b,* and the sheet 4 is integrated with the upper and lower midsoles 3*a,* 3*b.* Also, the upper midsole 3*a* extends from the heel portion to the forefoot portion of a shoe 1, whereas the lower midsole 3*b* is disposed mainly at the heel portion.

The midsole 3 is generally formed of soft elastic material having good cushioning properties. Specifically, thermoplastic synthetic resin foam such as ethylene-vinyl acetate copolymer (EVA), thermosetting resin foam such as polyurethane (PU), or rubber material foam such as butadiene or chloroprene rubber are used.

The corrugated sheet 4 is preferably formed of thermoplastic resin such as thermoplastic polyurethane (TPU) of comparatively rich elasticity, polyamide elastomer (PAE), ABS resin or the like. Alternatively, the corrugated sheet 4 is formed of thermosetting resin such as epoxy resin, unsaturated polyester resin and the like. The corrugated sheet may be formed of a plate made of elastic metal, or a meshed sheet made of elastic metal fibers.

At the contact portions of the midsole 3 with the corrugated sheet 4 are formed a plurality of transverse holes 6, 7 extending laterally (into the page of FIG. 1). These holes 6, 7 are provided for improving cushioning properties of the midsole 3 and decreasing its weight.

Figure 2:
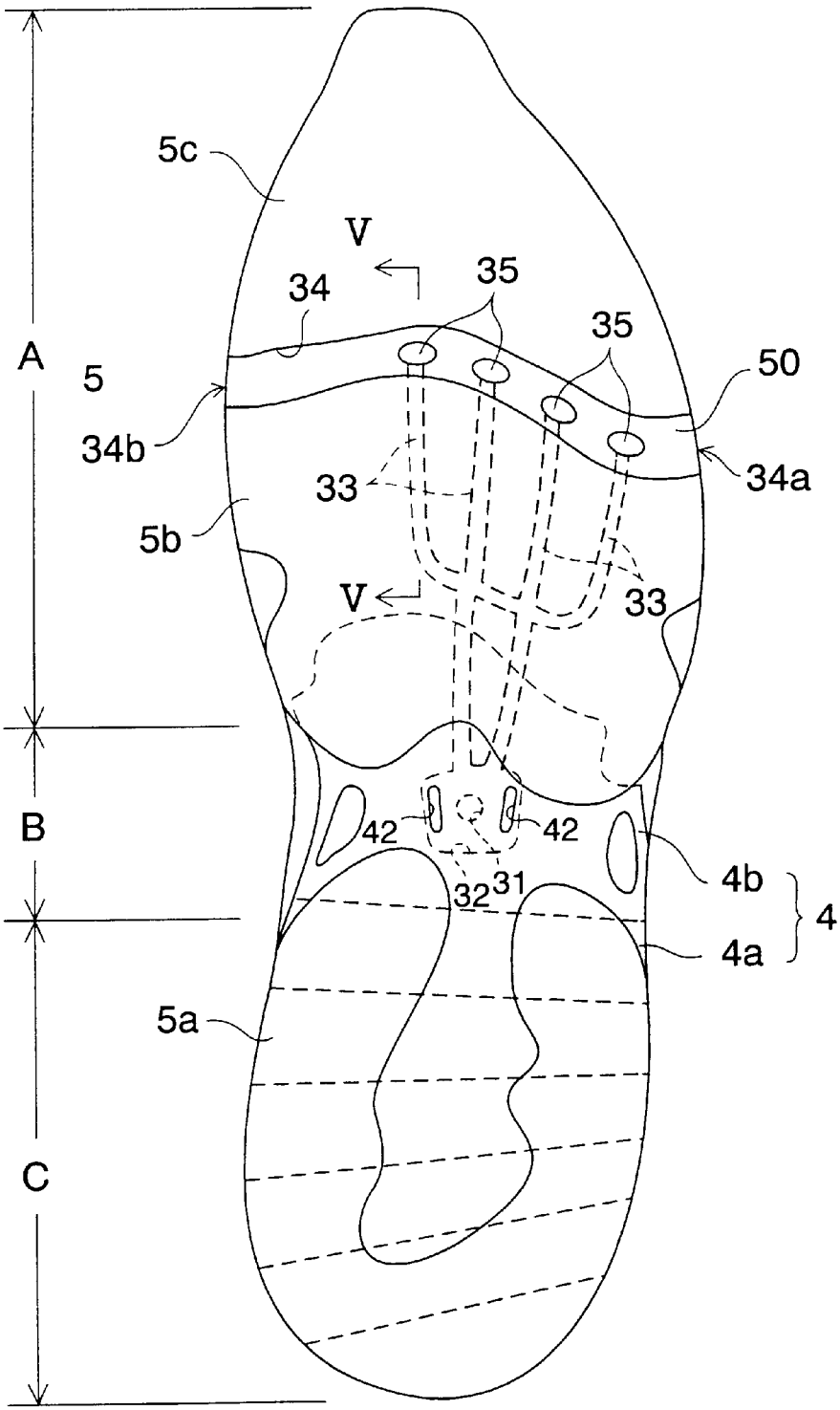
FIG. 2 is a bottom view of the left foot side sole construction of the present invention.
Figure 3:
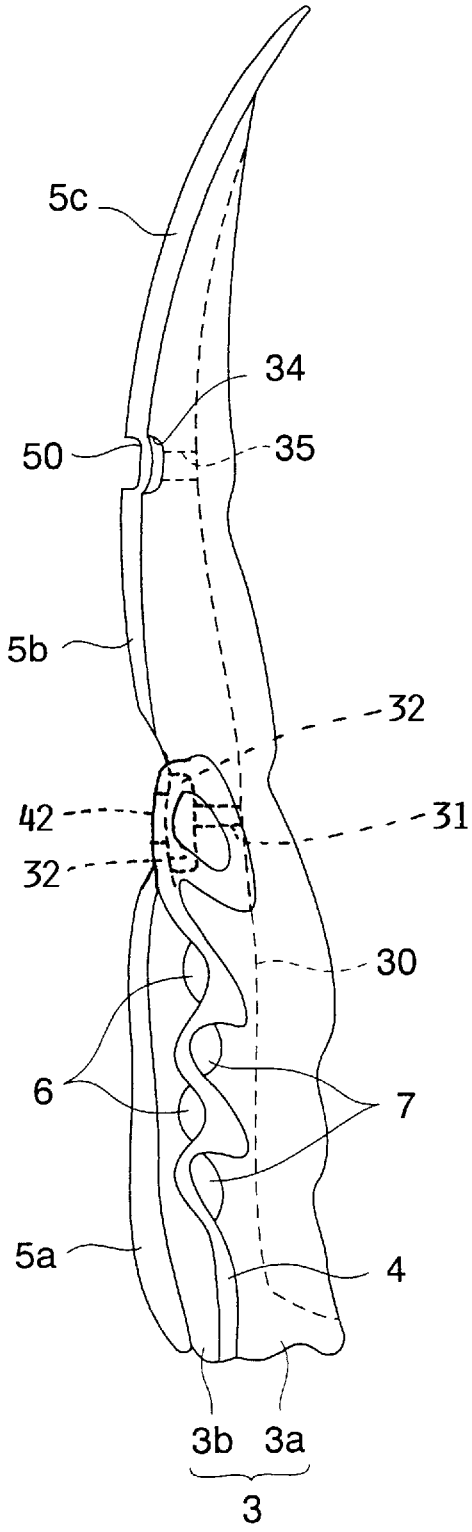
FIG. 3 is a lateral side view of the sole construction of FIG. 2.
Figure 5:
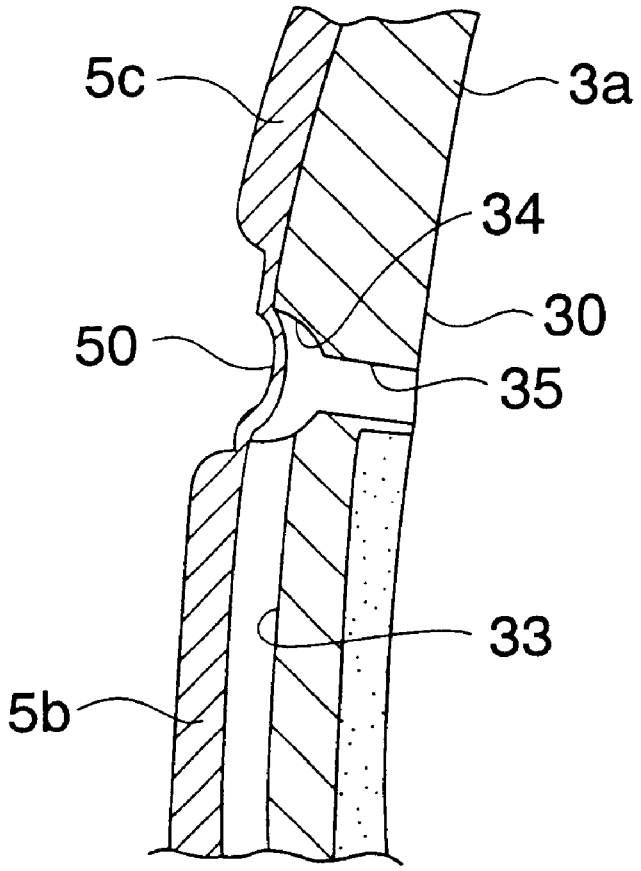
FIG. 5 is a cross sectional view of FIG. 2 taken along line V—V.

As shown in FIGS. 2 and 3, a curved groove 34, which extends substantially laterally, or in the general shoe width direction, is formed on the bottom side of the forefoot region A of the upper midsole 3*a.* A plurality of vertically extending through holes 35 are formed to extend vertically through the upper midsole 3*a* and communicate into the curved groove 34. The through holes 35 are open on the plantar contact face 30 of the upper midsole 3*a,* shown in FIGS. 5 and 6.

Figure 4:
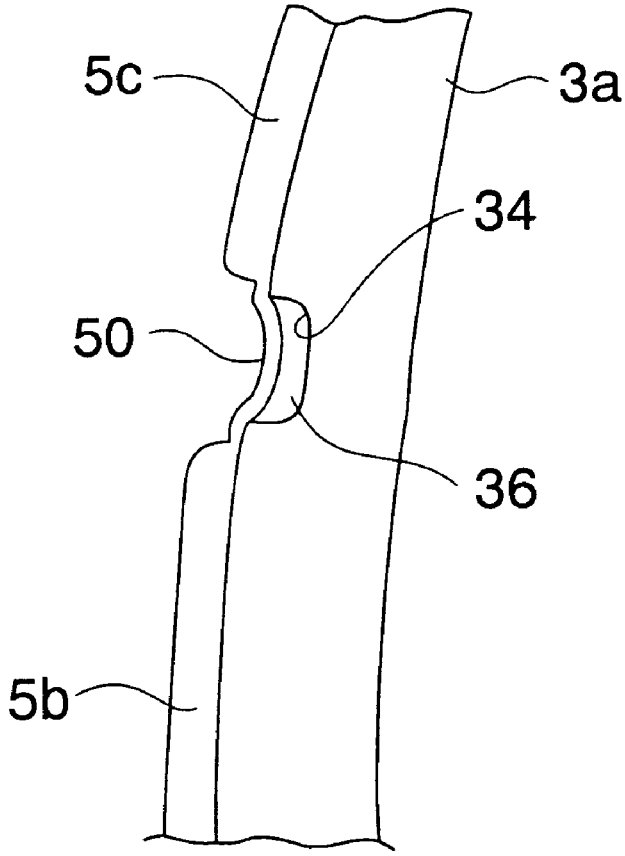
FIG. 4 is an enlarged view of a portion of FIG. 3.

The curved groove 34 is covered with the resin mold cover portion 50, which is integrally formed with the outsole 5, mentioned hereinafter. The space surrounded by the curved groove 34 and the cover portion 50 creates an air tube 36, as is clearly seen in FIG. 4. Both ends of the air tube 36 are open at the medial and lateral sides of the shoe. Preferably, the cover portion 50 has a bent shape toward the bottom face of the curved groove 34 so that the cover portion 50 can return to its original position with ease after bent deformation of the forefoot portion of the shoe.

A plurality of grooves 33 communicating with the through holes 35 in the curved groove 34 are formed in the bottom surface of the upper midsole 3*a* at the forefoot region A of the upper midsole 3*a.* A vertically extending through hole 31 is formed in the upper midsole 3*a* at the midfoot region B, or the plantar arch portion, of the upper midsole 3*a*. At the opening portion of the through hole 31 on the bottom side of the upper midsole 3*a,* there is formed a concave portion 32, or a recess, in communication with the grooves 33. The corrugated sheet 4 extends from the heel region C to the midfoot region B, or a plantar arch portion, of the midsole 3, and it is comprised of a heel portion 4*a* having a corrugated configuration and a generally planar midfoot portion 4*b* formed integrally with the heel portion 4*a*. The broken lines extending in the lateral direction at the heel portion 4*a* of FIG. 2 each respectively show a crest or a trough of the corrugation of the corrugated sheet 4.

Figure 6:
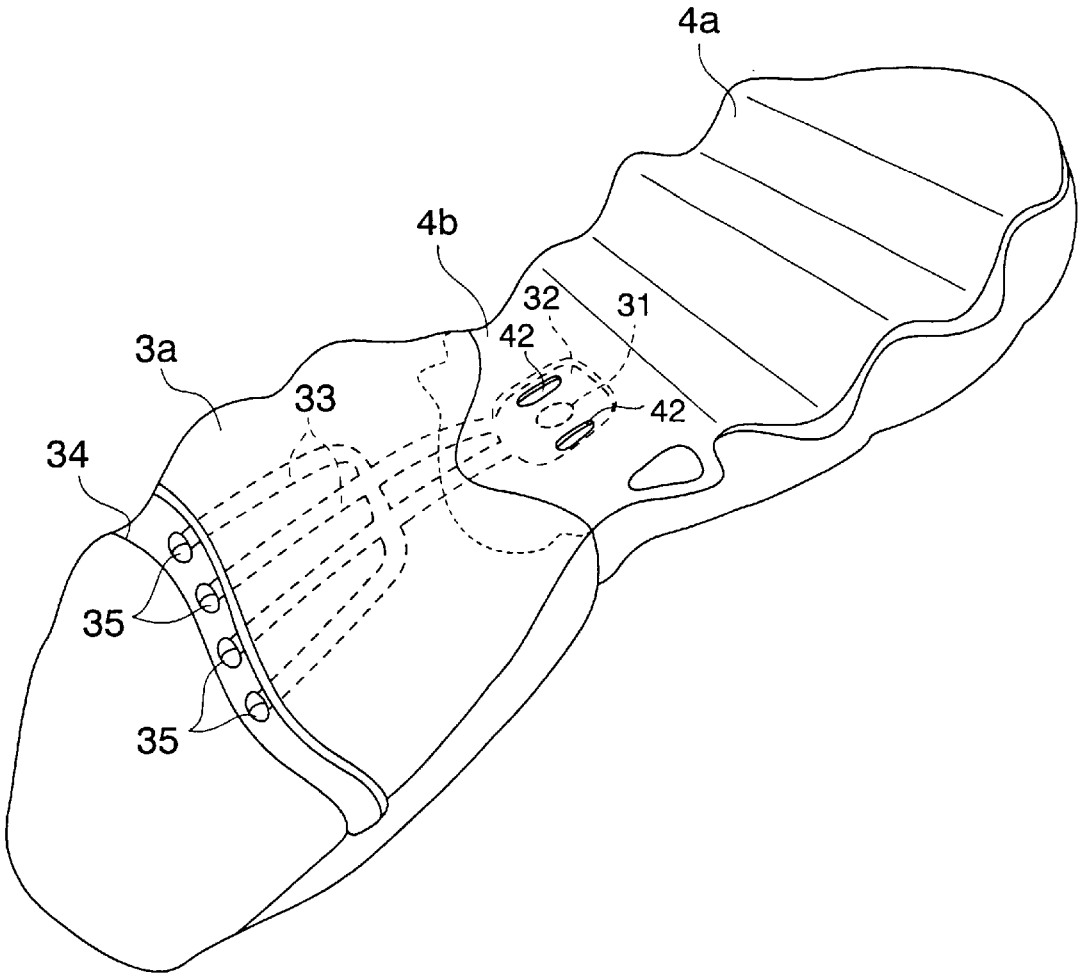
FIG. 6 is a perspective view of the upper midsole of the sole construction of FIG. 2, showing a corrugated sheet fitted on the bottom side of the upper midsole.

As shown in FIGS. 2 and 6, the recess 32, which is formed at the midfoot region B of the upper midsole 3*a,* is covered with the midfoot portion 4*b* of the corrugated sheet 4 and the midfoot portion 4*b* is formed with a pair of slits 42, which are disposed opposite to (i.e. in registration with) the recess 32, but not in registration with the through hole 31.

The outsole 5, shown in FIGS. 2 and 3, is comprised of a heel portion 5*a* placed on the bottom face of the lower midsole 3*b* and forefoot portions 5*b* and 5*c* that are placed mainly on the forefoot region A of the upper midsole 3*a*. The heel portion 5*a* is separated from the forefoot portions 5*b,* 5*c.* The forefoot portions 5*b,* 5*c* are integrated with each other by the cover portion 50 extending along the curved groove 34.

In use of the shoe, the air, which has been introduced into the air tube 36 from the opening portions 34*a,* 34*b* on the medial and lateral sides, flows into the inside of the shoe via the through holes 35, thereby acquiring ventilation of the forefoot portion inside the shoe.

Also, the air, which has been introduced into the recess 32 of the upper midsole 3*a* from the slits 42 of the corrugated sheet 4, flows into the midfoot region B inside the shoe via the through hole 31 and also flows into the through hole 35 via the groove 33.

Moreover, in this case, the thickness of the upper midsole 3*a* is made smaller at the curved groove 34 compared to the other portions of the midsole 3*a,* which facilitates bending of the upper midsole 3*a* in the vertical direction along the curved groove 34, thereby improving flexibility, or bendability, of the upper midsole 3*a*. Also, improved flexibility of the upper midsole 3*a* allows for smoother transfer of the load and secures gripping properties when an athlete lands on the ground from the heel portion to the toe portion of the shoe.

Furthermore, the opening portion of the through hole 35 on the bottom side is prevented from being exposed to the ground by the cover portion 50. Thereby, water, sand, dust, and the like outside the shoe are blocked from entering the inside of the shoe via the through hole 35 when the shoe contacts with the ground. In such a way, the shoe can be used as an outdoor shoe.

Also, in this case, because the cover portion 50 is integrally formed with the forefoot portion 5*b,* 5*c* of the outsole 5, the whole shoe structure can be simplified. In addition, when the cover portion 50 is formed of the transparent resin, the through hole can be seen from the bottom side of the shoe (see e.g. FIG.2), which can improve the aesthetic impression.

In another embodiment, a valve member, which can open and close the air tube 36, may be employed at the opening portions 34*a,* 34*b* on both sides of the curved groove 34.

Figure 7:
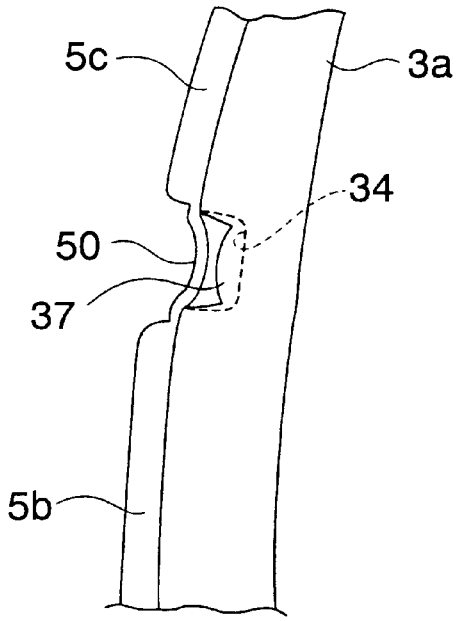
FIG. 7 shows an alternative embodiment of FIG. 4.

FIG. 7 shows such a valve member of the sole construction. In FIG. 7, a projection or a protrusion 37 is formed on the bottom side of the curved groove 34 in the vicinity of the opening portion and each of the opening portions 34*a,* 34*b* of the curved groove 34 is narrower compared to the above-identified embodiment shown in FIGS. 1–6.

Figure 8:
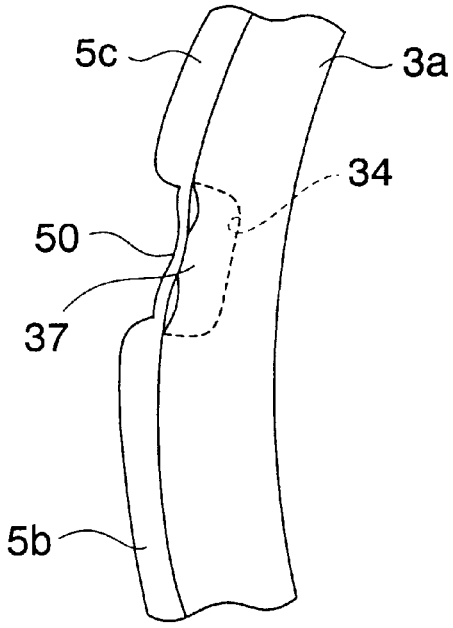
FIG. 8 is a schematic illustrating the action of the valve means of FIG. 7.

When the forefoot portion of the shoe bends from the condition shown in FIG. 7, the upper midsole 3*a* is bent and deformed into the shape shown in FIG. 8. Then, the protrusion 37 comes in contact with the cover portion 50 and the opening portions 34*a,* 34*b* are forced to be closed, which increases the air pressure inside the air tube 36. The pressure increased air in the air tube 36 easily flows through the through hole 35 and into the inside of the shoe, thereby advancing ventilation of the shoe.

Additionally, the groove or grooves 33 formed in the upper midsole 3*a* may be omitted in the embodiments shown in FIGS. 1–8. This is so because the open air can flow into the curved groove 34 mainly through the opening portions 34*a,* 34*b* on both sides of the curved groove 34 rather than through the groove 33. In such a way, the air can be supplemented into the air tube 36.

Figure 9:
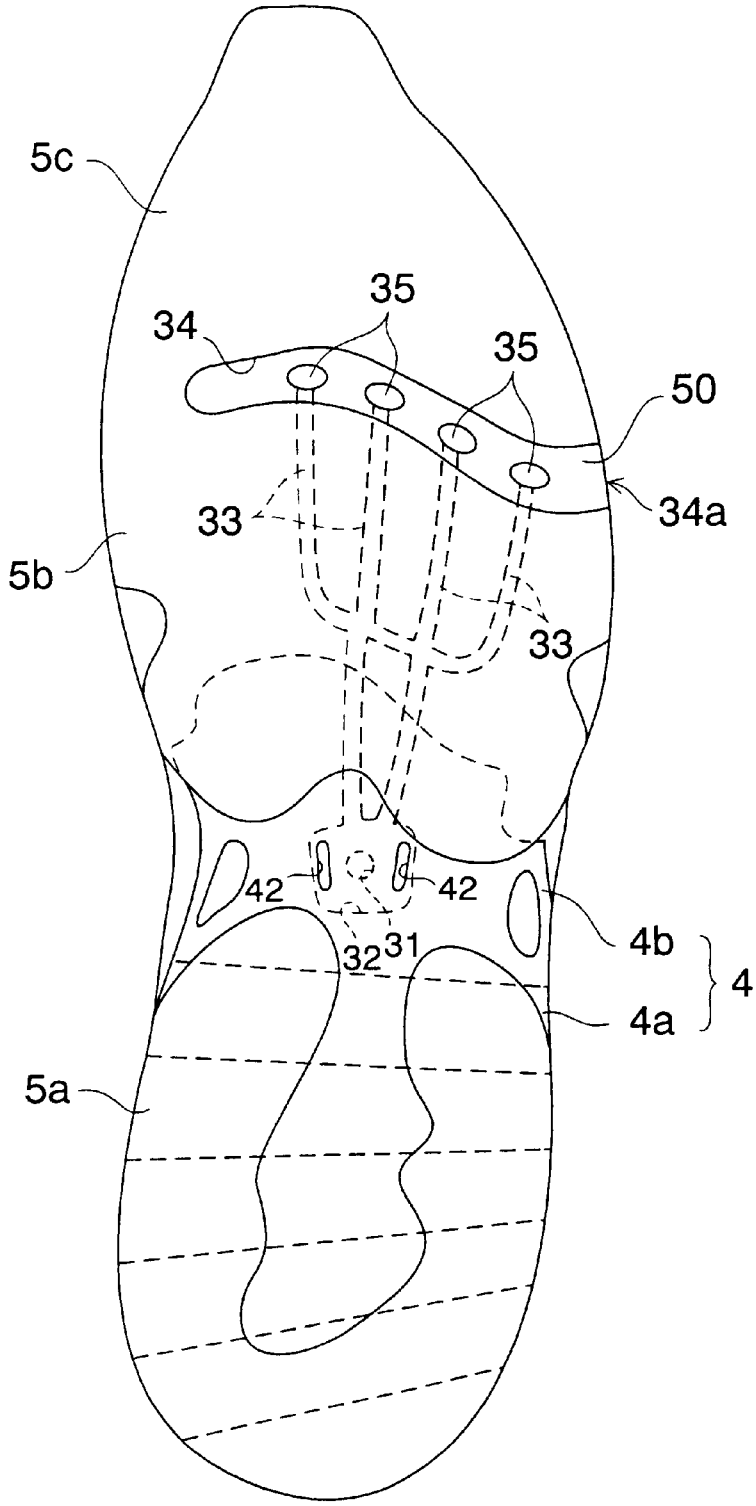
FIG. 9 shows an alternative embodiment of FIG. 2.

In still another embodiment, one end or both ends of the curved groove 34 may be tightly closed. FIG. 9 shows such a curved groove 34 one end of which is closed, or not open. At the time of bending of this forefoot portion, the air pressure in the air tube 36 easily increases, thereby allowing the pressure increased air in the air tube 36 to smoothly enter the inside of the shoe via the through hole 35, which can improve ventilation of the shoe.

In this embodiment as well, the valve member shown in FIG. 7 may be employed at the opening portion 34*a* of the curved groove 34. Thus, improved ventilation can be acquired.

On the other hand, when the both ends of the curved groove 34 are closed, or not open, the air is supplemented into the air tube 36 through the slit 42 of the corrugated sheet 4 to the recess 32 and through the groove 33 of the upper midsole 3*a*.

The recess 32, or concave portion, communicating with the groove 33 may be formed on the heel region C of the upper midsole 3*a*. In this case, the slit 42 corresponding to the recess 32 is formed on the heel portion 4*a* of the corrugated sheet 4. When the slit 42 is provided on the forefoot portion 4*b* or the heel portion 4*a* of the corrugated sheet 4, the position of the slit 42 is placed at a concave portion located away from the ground contact face of the shoe. Thus, water, sand, dust, and the like outside the shoe are prevented from entering the slit. The cover 50 is preferably integral with the outsole 5, but it can be separated from the outsole 5.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet still fall within the scope of the invention.

What is claimed is:

1. A sole assembly for an athletic shoe comprising a midsole member and a cover portion, wherein:

said midsole member is formed of a soft elastic material, includes a midsole forefoot portion and a midsole heel portion, terminates along a medial side edge and a lateral side edge, and is bounded by a midsole top surface and a midsole bottom surface, said midsole member has therein a curved transverse groove formed in said midsole bottom surface of said midsole forefoot portion and extending along a curve in a transverse direction between said medial side edge and said lateral side edge of said midsole forefoot portion, said midsole member has a first groove end opening at a first side edge selected from said medial side edge and said lateral side edge of said midsole forefoot portion through which said curved transverse groove is in communication outwardly through said first side edge with an ambient atmosphere surrounding said sole assembly, said cover portion is arranged adjoining said midsole bottom surface, and spanning and covering said curved transverse groove so as to define a transverse air tube in said curved transverse groove covered by said cover portion, said cover portion has an arched sectional shape arching into said curved transverse groove toward said midsole top surface, said midsole member has a protrusion of said midsole forefoot portion protruding into said curved transverse groove toward said cover portion proximate to said first groove end opening at said first side edge, said protrusion and said cover portion protrude toward each other and cooperate with each other to form a valve arrangement that selectively varies a cross-sectional opening area of said first groove end opening, and said midsole forefoot portion has a hole passing therethrough from said midsole top surface into said curved transverse groove.

2. The sole assembly according to claim 1, wherein said valve arrangement is an active valve arrangement that selectively reduces said cross-sectional opening area of said first groove end opening by said protrusion and said cover portion contacting each other when said midsole forefoot portion is flexed about said curved transverse groove, and that selectively increases said cross-sectional opening area of said first groove end opening by said protrusion and said cover portion being separated from each other when said midsole forefoot portion is unflexed about said curved transverse groove.

3. The sole assembly according to claim 1, further comprising an outsole arranged on said midsole bottom surface of said midsole forefoot portion, wherein said cover portion is integrally formed and integrally joined with said outsole.

4. The sole assembly according to claim 1, wherein said cover portion consists of a transparent plastic resin and is visibly exposed from an outside of said sole assembly.

5. The sole assembly according to claim 1, wherein said curve along which said curved transverse groove extends is a meandering curve including a first curve portion that is convex toward said midsole heel portion and a second curve portion that is concave toward said midsole heel portion.

6. The sole assembly according to claim 1, wherein said midsole member further includes a midsole arch portion between said midsole forefoot portion and said midsole heel portion, said midsole member has a recess cavity formed in said midsole bottom surface of said midsole arch portion or said midsole heel portion, and said midsole member has another hole passing therethrough from said midsole top surface into said recess cavity.

7. The sole assembly according to claim 6, wherein said midsole further has a longitudinal groove formed in said midsole bottom surface and communicating from said recess cavity to said curved transverse groove and said hole in said midsole forefoot portion.

8. The sole assembly according to claim 6, further comprising a sheet arranged on said midsole bottom surface of said midsole arch portion and said midsole heel portion, wherein said sheet covers said recess cavity, and wherein said sheet has a slit therethrough that communicates from the ambient atmosphere surrounding said sole assembly into said recess cavity and that is not in direct registration with said another hole.

9. The sole assembly according to claim 6, further comprising a sheet arranged on said midsole bottom surface of said midsole arch portion and said midsole heel portion, wherein said sheet includes a non-corrugated sheet portion on said midsole arch portion and a corrugated sheet portion on said midsole heel portion, wherein said midsole heel portion is an upper midsole heel portion, and further comprising a lower midsole heel portion arranged below said corrugated sheet portion opposite said upper midsole heel portion.

10. The sole assembly according to claim 9, wherein said sheet is a plate of an elastic metal.

11. The sole assembly according to claim 9, wherein said sheet is a mesh of elastic metal fibers.

12. A sole assembly for an athletic shoe comprising a midsole member and a cover portion, wherein:

said midsole member is formed of a soft elastic material, includes a midsole forefoot portion and a midsole heel portion, terminates along a medial side edge and a lateral side edge, and is bounded by a midsole top surface and a midsole bottom surface, said midsole member has therein a curved transverse groove formed in said midsole bottom surface of said midsole forefoot portion and extending along a curve in a transverse direction between said medial side edge and said lateral side edge of said midsole forefoot portion, said cover portion is arranged adjoining said midsole bottom surface, and spanning and covering said curved transverse groove so as to define a transverse air tube in said curved transverse groove covered by said cover portion, said cover portion has an arched sectional shape arching into said curved transverse groove toward said midsole top surface, said midsole forefoot portion has a hole passing therethrough from said midsole top surface into said curved transverse groove, two opposite ends of said transverse air tube respectively directed toward said lateral side edge and said medial side edge are closed and not in communication with an ambient atmosphere surrounding said sole assembly, said midsole member further includes a midsole arch portion between said midsole forefoot portion and said midsole heel portion, said midsole member has a recess cavity formed in said midsole bottom surface of said midsole arch portion or said midsole heel portion, and said midsole member has another hole passing therethrough from said midsole top surface into said recess cavity, and said midsole further has a longitudinal groove formed in said midsole bottom surface and communicating from said recess cavity to said curved transverse groove and said hole in said midsole forefoot portion.

13. The sole assembly according to claim 12, further comprising a sheet arranged on said midsole bottom surface of said midsole arch portion and said midsole heel portion, wherein said sheet covers said recess cavity, and wherein said sheet has a slit therethrough that communicates from the ambient atmosphere surrounding said sole assembly into said recess cavity and that is not in direct registration with said another hole.

14. The sole assembly according to claim 12, further comprising an outsole arranged on said midsole bottom surface of said midsole forefoot portion, wherein said cover portion is integrally formed and integrally joined with said outsole.

15. The sole assembly according to claim 12, wherein said cover portion consists of a transparent plastic resin and is visibly exposed from an outside of said sole assembly.

16. The sole assembly according to claim 12, wherein said curve along which said curved transverse groove extends is a meandering curve including a first curve portion that is convex toward said midsole heel portion and a second curve portion that is concave toward said midsole heel portion.

17. The sole assembly according to claim 12, further comprising a sheet arranged on said midsole bottom surface of said midsole arch portion and said midsole heel portion, wherein said sheet includes a non-corrugated sheet portion on said midsole arch portion and a corrugated sheet portion on said midsole heel portion, wherein said midsole heel portion is an upper midsole heel portion, and further comprising a lower midsole heel portion arranged below said corrugated sheet portion opposite said upper midsole heel portion.

18. The sole assembly according to claim 17, wherein said sheet is a plate of an elastic metal.

19. The sole assembly according to claim 17, wherein said sheet is a mesh of elastic metal fibers.

* * * * *